US005685372A

United States Patent [19]

Gano

[11] Patent Number: 5,685,372

[45] Date of Patent: *Nov. 11, 1997

[54] TEMPORARY PLUG SYSTEM

[75] Inventor: John C. Gano, Carrollton, Tex.

[73] Assignee: Halliburton Energy Services, Inc., Dallas, Tex.

[ * ] Notice: The term of this patent shall not extend beyond the expiration date of Pat. No. 5,479,986.

[21] Appl. No.: 561,754

[22] Filed: Nov. 22, 1995

Related U.S. Application Data

[63] Continuation-in-part of Ser. No. 236,436, May 2, 1994, Pat. No. 5,479,986.

[51] Int. Cl.[6] ..... E21B 33/13

[52] U.S. Cl. ..... 166/292; 166/192

[58] Field of Search ..... 166/135, 192, 166/292, 285, 281

[56] References Cited

U.S. PATENT DOCUMENTS

| | | | |
|---|---|---|---|
| 3,362,476 | 1/1968 | Van Poollen | 166/21 |
| 4,186,803 | 2/1980 | Mondshine | 166/307 |
| 4,374,543 | 2/1983 | Richardson | 166/192 |
| 4,721,159 | 1/1988 | Ohkochi et al. | 166/286 |
| 5,417,285 | 5/1995 | Van Buskick et al. | 166/281 X |
| 5,479,986 | 1/1996 | Gano et al. | 166/292 |

*Primary Examiner*—William P. Neuder

*Attorney, Agent, or Firm*—William M. Imwalle; Shawn Hunter

[57] ABSTRACT

A method and apparatus for establishing and substantially destroying a fluid-type plug which is substantially dissolvable in fluid. A means for selectively opening a fluid port to the plug member is described which causes dissolution of the plug to occur. The plug member is maintained within a plug housing which also contains the fluid port. The plug housing is received within an annular sleeve which serves to seal the plug housing port against fluid intrusion into the plug housing port. The sleeve also contains an aperture which will become generally aligned with the plug housing port as the plug housing is axially separated from the annular sleeve. Axial separation of the plug housing and sleeve is accomplished by selectively pressurizing and depressurizing the flowbore containing the plug assembly to remove support for the plug housing.

14 Claims, 4 Drawing Sheets

TEMPORARY PLUG SYSTEM

This application is a continuation-in-part of application Ser. No. 236,436, filed May 2, 1994 which issued as U.S. Pat. No. 5,479,986 on Jan. 2, 1996.

BACKGROUND OF THE INVENTION

1. Field of the Invention

The present invention relates to bridge plugs and other plugs which are set within a wellbore housing. More particularly, the present invention relates to a means for providing a plug on a temporary basis which may be substantially destroyed when required.

2. Description of the Related Art

In conventional practice, when a well or formation within a well must be closed off, it is common to establish a plug within the wellbore to close off the flow of fluids across the plugged off area. The drillable plugs, usually used during cementing procedures, are made of soft metals through which a drill bit can pass and are intended to be removed by drilling. "Retrievable" plugs are intended to be easily removed from a wellbore. They are run into the well on tubing or cable and removed the same way.

If it becomes necessary to re-establish that portion of the well closed off by the plug, tools must be removed from the wellbore before the workers can attempt to remove the plugs. Removal of the tools, drilling of the plug and re-establishing of the well entail significant cost and rig time. It is, therefore, desirable to develop a plug which may be readily removed or destroyed without either significant expense or rig time. Some wellbore blocking means have been developed which utilize a central frangible element which is either pierced or smashed by mechanical means such as a special wire line tool having sinker bar and star bit or which is shattered by an increased pressure differential from above. Also known is a one piece, frangible ceramic sealing element which may be closed to block flow through a wellbore. After use, the element is shattered by impacting with a tooth-faced blindbox hammer under force of gravity. The remaining pieces must then be washed out of the wellbore with completion fluid or the like. These designs are unsuitable for many customers since elimination of the pieces of the frangible blockers, such as by washing out or by pushing to the bottom of the well, before the customer can resume operations is a time-consuming and expensive prospect. Common designs which use a mechanical impact means to destroy the flow blocker require an additional tool run on wireline or tubing to lower and then remove the impact means. In addition, these frangible blockers are supported about their circumference and, therefore, prove to fail proximate their centers. Large pieces may be left around the edges and present hindrances to the passage of well tools.

Recently, temporary plugs have been developed which are composed primarily of salt and sand and which are the subject matter of U.S. patent application Ser. No. 08/236,436, the contents of which is incorporated herein by reference. These types of plugs may be rapidly destroyed in their essential entirety by exposure of the salt and sand mixture to pressurized wellbore fluids.

SUMMARY OF THE INVENTION

The present invention relates to a method and apparatus for establishing and substantially destroying a fluid-type plug member which is substantially dissolvable in fluid. The invention features means for selectively opening a fluid port to the plug member to cause dissolution to occur.

In the embodiment of the invention described herein, the plug member is maintained within a plug housing which also contains the fluid port. The plug housing is received within an annular sleeve which serves to seal the plug housing port against fluid intrusion into the plug housing's port. The sleeve also contains an aperture which will become generally aligned with the plug housing port as the plug housing is axially separated from the annular sleeve. Axial separation of the plug housing and sleeve is accomplished by selectively pressurizing and depressurizing the flowbore containing the plug assembly to remove support for the plug housing.

BRIEF DESCRIPTION OF THE DRAWINGS

As shown in FIG. 1, the plug assembly is configured in a working mode with the plug intact.

DETAILED DESCRIPTION OF PREFERRED EMBODIMENTS

Figure 1:
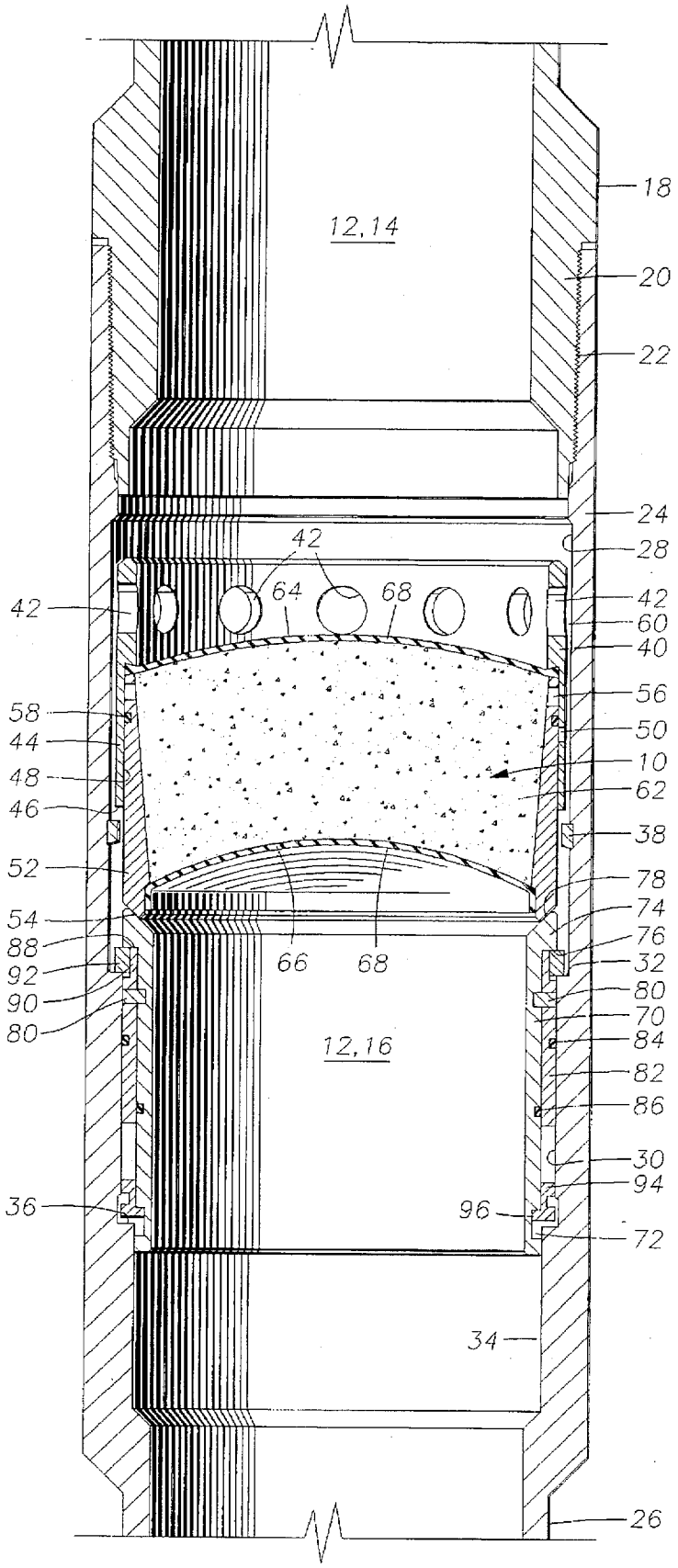
FIG. 1 depicts an exemplary plug arrangement in accordance with the present invention. The plug is positioned so as to block fluid flow downwardly through a wellbore.

The invention is best described with reference to FIGS. 1 through 4 which illustrate a plug assembly 10 which is maintained within a flowbore 12 which has an upper portion 14 and a lower portion 16 which are separated by the plug assembly 10. Both or either portions 14, 16 may contain wellbore fluids. The upper portion 14 of the flowbore 12 generally is placed under greater pressure than the lower portion 18 and, during operation, receives pressure increases and decreases from the surface (not shown). In the described embodiment, the flowbore 12 is defined within a production tubing string which is indicated generally at 18. It should be understood, however, that the flowbore 12 might be defined by other strings of tubular members such as a casing string. The tubing string 18 is normally made up of a number of interconnected tubular components above and below the plug assembly 10. An upper tubular member 20 is shown which is affixed by threading or other means (not shown) to components extending toward the surface or opening (not shown) of the flowbore 12. The upper tubular member 20 is also connected by threads 22 to the plug assembly housing 24 which, in turn may be connected proximate its lower end 26 to components (not shown) extending below the plug assembly 10.

The plug assembly housing 24 features an expanded upper bore 28 and an intermediate bore 30 of reduced diameter which are separated by an upper upward-facing and inwardly-projecting shoulder 32. A lower bore 34 of further reduced diameter is separated from the intermediate bore 30 by upward-facing inwardly directed shoulder 36. The upper bore 28 contains an inwardly directed annular protrusion 38.

The plug assembly 10 is generally located primarily within the upper and intermediate bores 28, 30 and extends slightly downwardly into the lower bore 34. The plug assembly 10 includes an annular upper sleeve 40 having a plurality of ports 42 about its upper circumference. The upper sleeve 40 includes a lower wall 44 with a lower edge 46 and a radially expanded lower interior retaining recess 48. A fluid aperture 50 is disposed within the wall 44.

A metallic plug housing 52 is slidingly received within the recess 48. The plug housing 52 features a lower edge 54 which is outwardly tapered or spherical. The plug housing 52 contains a lateral port 56 proximate its upper end. When the plug housing 52 is fully received within the retaining recess 48, the lateral port 56 of the plug housing 52 is not aligned with the apertures 50 of the upper sleeve 40. One or more elastomeric seals 58 may be provided within the plug housing 52 to ensure a fluid seal is maintained between the plug housing 52 and the upper sleeve 40 such that wellbore fluids surrounding the plug assembly 10 will not intrude into the lateral port 56 of the plug housing 52. Spacing of the plug housing 52 and upper sleeve 40 from the upper bore 28 forms a fluid passage 60 around the plug 10.

Plug 62 is maintained within the plug housing 52. The plug 62 is substantially comprised of a salt and sand mixture which is highly resistant to fluid compressive forces but which may be rapidly and substantially destroyed and dissolved within wellbore fluids. Plugs of this nature and methods of making these plugs are described in greater detail in U.S. patent application Ser. No. 08/236,436, filed May 2, 1994 which is assigned to the assignee of the present invention and incorporated herein by reference. For purposes of the present invention, it is preferred that the plug 62 be made up of a mix of salt and sand combined in approximately a 50/50 mix. 3½% water is then added and the mix is placed into a plug mold to form the plug 62. During molding, the plug mix is heated to 350° F. and subjected to between 10,000–15,000 lbs. per square inch of pressure. The plug 62 presents an upper convex surface 64 and a lower concave surface 66, each of which is covered by a thin elastomeric membrane 68 to protect the interior salt/sand portions of the plug 62 from premature contact with wellbore fluids. It is noted that the use of convex and concave surfaces for surfaces 64, 66 provides improved load distribution. However, it is not necessary for the surfaces 64, 66 to be convex, concave, curved or shaped in any particular manner for the invention to function.

Below the plug 62, a generally cylindrical loading sleeve 70 is slidably disposed within the plug assembly housing 24. At its lower end, the loading sleeve 70 includes an outwardly directed annular recess 72. The loading sleeve 70 also presents a radially outwardly expanded upper portion 74 which presents a downwardly facing outer stop face 76 and an upward, inwardly directed frustoconical plug housing seat 78 which is generally complimentary to the lower edge 54 of the plug housing 52. When the lower edge 54 is engaged with the plug housing seat 78, a generally fluid tight seal is formed between them.

The loading sleeve 70 is affixed by means of one or more shear pins 80 to a surrounding support sleeve 82 which is reciprocably disposed between the loading sleeve 70 and the plug assembly housing 52. One or more outer elastomeric seals 84 may be disposed between the support sleeve and the plug assembly housing 24. In addition, one or more elastomeric seals 86 may be disposed between the support sleeve 82 and the loading sleeve 70. The effect of the elastomeric seals 84 and 86 is to prevent fluid from bypassing the support sleeve 82 under pressure. The upper end 88 of the support sleeve 82 forms a loading surface upon which pressure is received. In addition, the upper end 88 of the support sleeve 82 includes an upwardly extending flange 90.

A C-ring or split ring 92 is maintained radially within the plug assembly housing 24 above and seated upon the shoulder 32 of the plug assembly housing 24. The C-ring 92 is biased radially inwardly but is maintained initially in a radially expanded condition due to blocking by the flange 90 of the support sleeve 82. An annular shear member 94 is located proximate the lower portion of the loading sleeve 70 above the lower shoulder 36 within the plug assembly housing 24. The annular shear member 94 includes an inwardly projecting flange 96 which is disposed initially within the outer recess 72 of loading sleeve 70.

The operation of the exemplary plug assembly 10 is illustrated by reference to FIGS. 1 through 4. As shown in FIG. 1, the plug assembly 10 is configured as it would be initially for blocking fluid flow across a portion of the flowbore 12. Fluid pressure is greater in the upper portion 14 of the flowbore 12 than it is in the lower portion 16. With the plug assembly 10 in a first position, illustrated in FIG. 1, pressure loading from the upper wellbore portion 14 is transmitted through the plug assembly 10 as follows. Pressure loading upon the upper surface 64 of the plug member 62 will be transmitted through the plug member housing 52 to the loading sleeve 70. Through engagement of the stop face 76 with C-ring 92, this pressure loading is transmitted to the shoulder 32 of the plug assembly housing 24.

Pressure above the plug assembly 10 may be increased and decreased as desired so long as the pressure is not increased to an amount equal to or exceeding the shear value provided by shear pins 80. Such pressure increases and decreases might be used for pressure testing portions of the flowbore 12 above the plug assembly 10 or for setting packers or manipulating other pressure operated devices in the upper flowbore portion 14.

When it is desired to destroy the plug 62 and thereby permit fluid flow across the plug assembly 10, fluid pressure in the upper portion of the flowbore 14 should be increased to an amount which exceeds the value of shear pins 80. Pressure so applied will pass through the fluid passage 60 and across C-ring 92 (due to its cutout or break) and ultimately be applied to the upper end 88 of the support sleeve 82 to shear pins 80.

Figure 2:
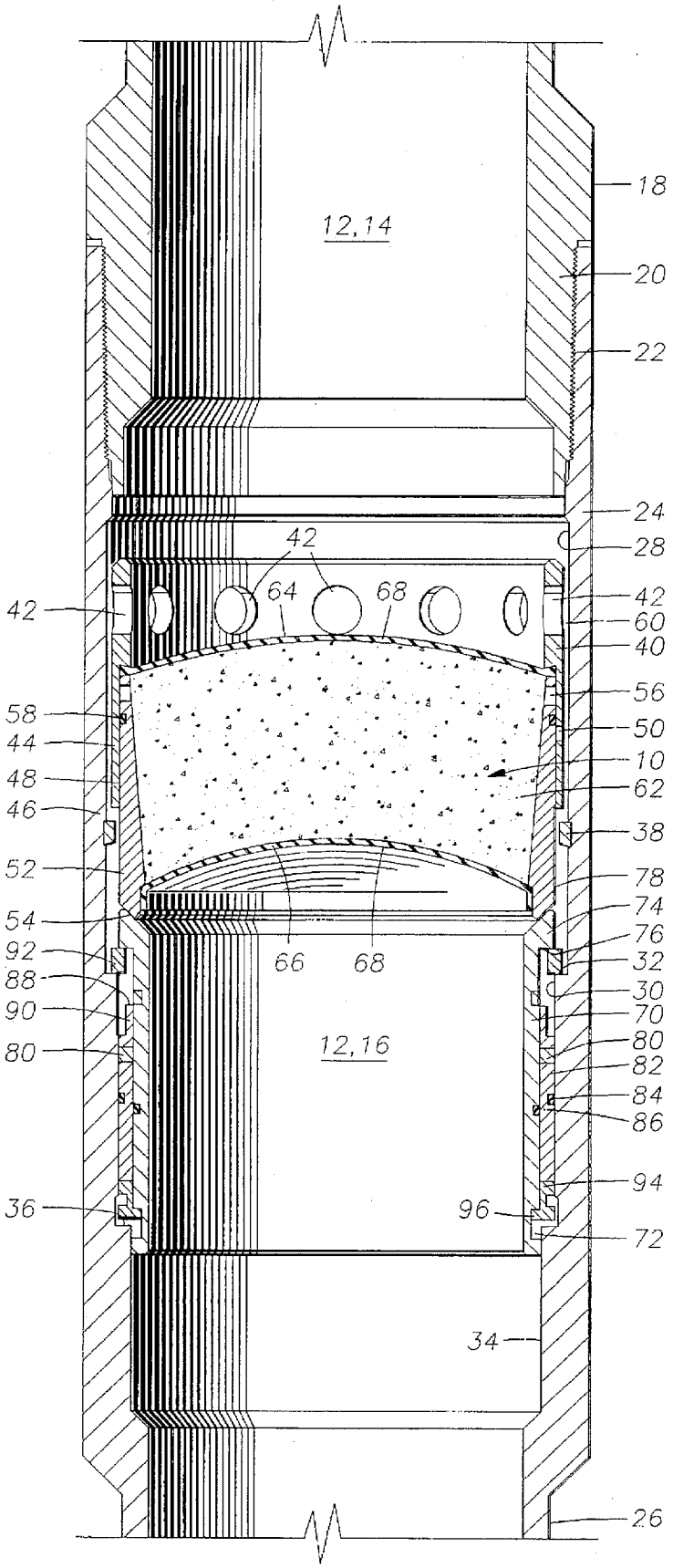
FIG. 2 depicts the plug assembly following sufficient pressurization to move the plug to a first position.

As the shear pins 80 are sheared, the support sleeve 82 will move downward with respect to the loading sleeve 70, as shown in FIG. 2. Pressure loading on the support sleeve 82 will cause the support sleeve 82 to move downwardly until it contacts shear member 94. Pressure loading is then transmitted through the annular shear member 94 to the shoulder 36 of the plug assembly housing 24 (see, e.g. FIG. 3). Pressure loading from the upper wellbore portion 14 also continues to maintain the C-ring 92 in its radially expanded condition by transferring load through it to the plug assembly housing 24 as described previously.

Figure 3:
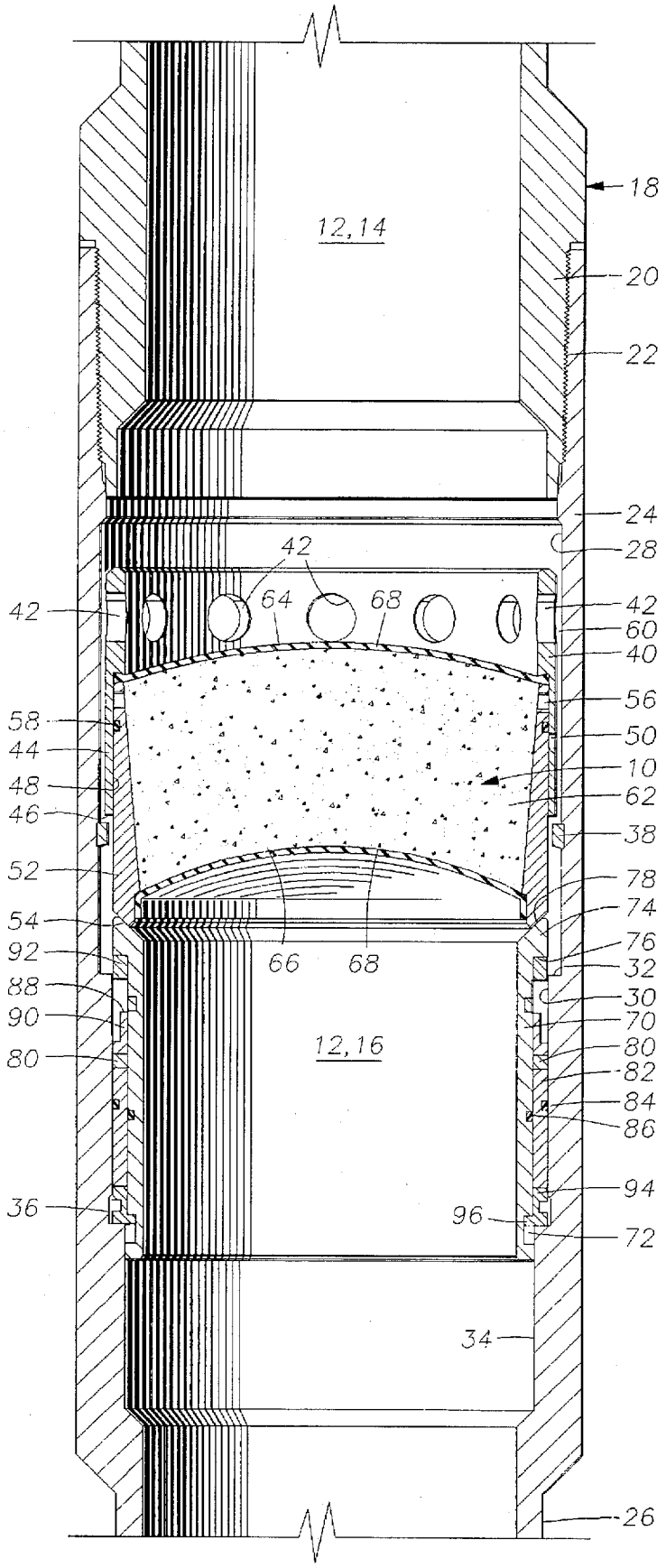
FIG. 3 depicts the plug assembly following a subsequent pressurization to move the plug to a second position.
Figure 4:
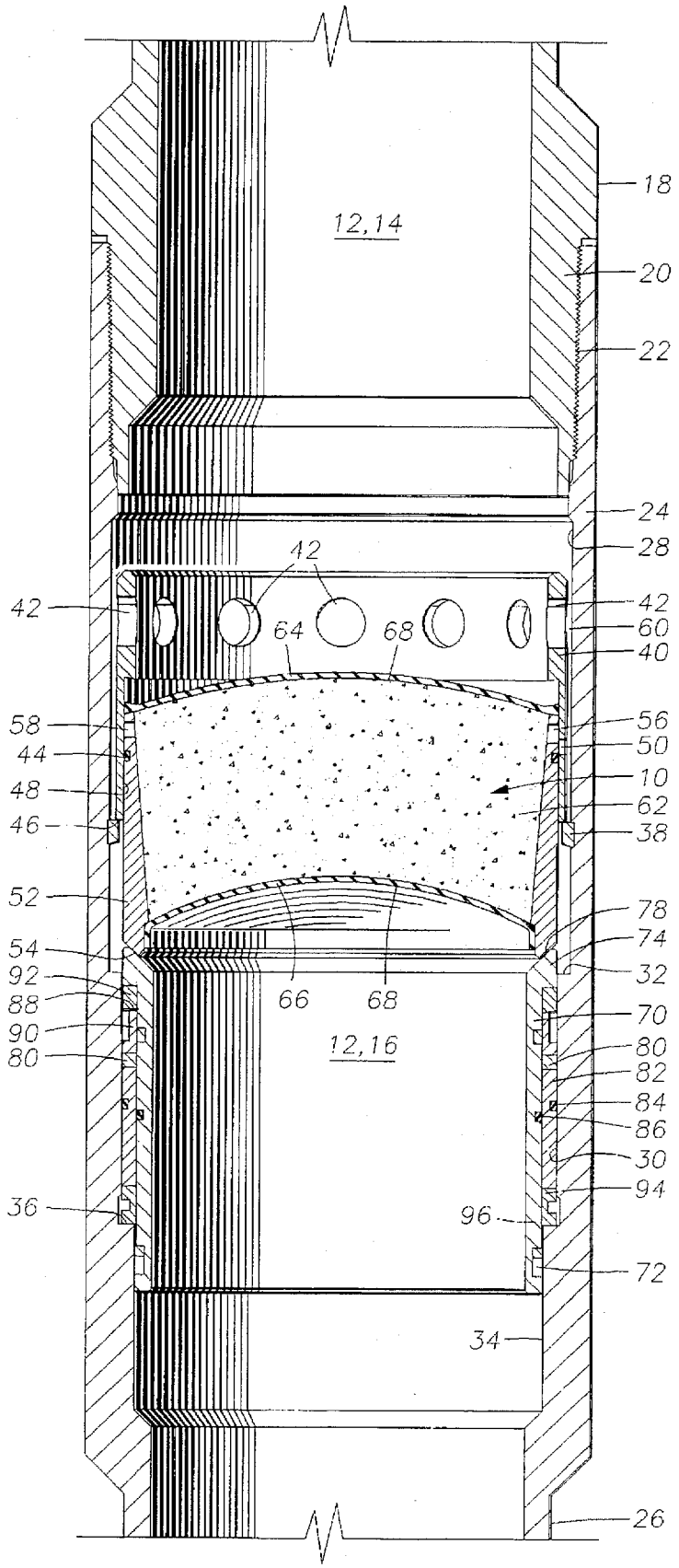
FIG. 4 shows the plug assembly in its final position open to well fluids.

As fluid pressure in the upper portion of the flowbore 14 is subsequently removed, loading of the plug assembly 10 in the manner described above is reduced sufficiently to permit the C-ring 92 to retract radially inwardly as illustrated in FIG. 3. Once the C-ring 92 has retracted radially inwardly, the upper portion of the flowbore 14 may be repressurized, this time to a degree sufficient to shear the flange 96 from the annular shear member 94. As this occurs, the loading sleeve 70 moves downward within the plug assembly housing 24 as shown in FIG. 4. The lower edge 46 of the upper sleeve 40 will abut inward protrusion 38 forcing the upper sleeve 40 axially upward with respect to the plug housing 52. As the plug housing 52 and upper sleeve 40 become axially separated, the fluid seal between the plug housing 52 and the upper sleeve 40 is broken and ports 56 and apertures 50 become generally aligned to permit fluid from the upper flowbore portion 14 to intrude and contact plug 62. Once salt soluble fluid contacts the plug 62, the salt and sand mixture quickly loses its integrity and pressure from the upper flowbore portion 14 urges its way through the structure of plug 62. Membranes 68 are ruptured and destroyed. The salt and sand constituents of the plug 62 are then dissolved into the wellbore fluid.

Thus it has been shown that the temporary plug illustrated and described herein fulfills the objects of the invention set forth at the beginning of this application.

The foregoing description and drawings of the invention are explanatory and illustrative thereof, and various changes in sizes, shapes, materials, and arrangement of parts, as well as certain details of the illustrated construction, may be made within the scope of the appended claims without departing from the true spirit of the invention. Accordingly, while the present invention has been described herein in detail to its preferred embodiment, it is to be understood that this disclosure is only illustrative and exemplary of the present invention and is made merely for the purposes of providing and enabling disclosure of the invention. The foregoing disclosure is not intended or to be construed to limit the present invention or otherwise to exclude any such embodiments, adaptations, variations, modifications, and equivalent arrangements, the present invention being limited only by the claims appended hereto and the equivalents thereof.

What is claimed is:

1. A plug assembly for selective blocking of a flowbore, the plug assembly comprising:

a. a plug member substantially comprised of materials which are dissolvable in fluid; and b. a port which may be selectively opened to provide fluid access to the plug member.

2. The plug assembly of claim 1 wherein the plug member is substantially comprised of sand and salt.

3. The plug assembly of claim 2 further comprising an elastomeric membrane covering portions of the plug member.

4. The plug assembly of claim 2 wherein the plug member presents a convex upper surface.

5. The plug assembly of claim 1 further comprising a plug housing which radially surrounds the plug member and contains the port.

6. The plug assembly of claim 5 further comprising an annular sleeve containing a recess into which the plug housing is received, the port of the plug housing being selectively opened through alignment of said port with an aperture within said sleeve.

7. The plug assembly of claim 6 wherein the port and the aperture are generally aligned as the sleeve and plug housing are axially separated such that the plug housing is withdrawn from the recess of the annular sleeve.

8. The plug assembly of claim 7 wherein the sleeve and plug housing are axially separated by sequentially pressurizing and depressurizing of a flowbore within which the plug assembly is placed.

9. The plug assembly of claim 8 further comprising a loading sleeve presenting a plug housing seat and adapted to support the plug housing, the loading sleeve being selectively maintained in a position supporting the plug housing by an inwardly biased, radially expandable C-ring.

10. The plug assembly of claim 9 wherein the loading sleeve is further maintainable in said supporting position by a shearable member which may be sheared to release the loading sleeve from said supporting position.

11. The plug assembly of claim 9 further comprising an axially moveable support sleeve which is moveable between first and second positions and having an extending flange which maintains said C-ring in a radially expanded condition when said support sleeve is in its first position.

12. The plug assembly of claim 11 wherein the support sleeve is maintained in its first position by a shear pin.

13. A method for substantially destroying a flowbore plug which is dissolvable in fluids, the method comprising the steps of:

placing the plug within a flowbore so as to block fluid flow therethrough; and substantially destroying the plug by selectively opening a fluid port to communicate fluid to a portion of the plug and dissolve it.

14. The method of claim 13 wherein the plug is substantially destroyed by sequentially pressurizing and depressurizing portions of the flowbore within which the plug is located.

* * * * *